US006868819B2

(12) United States Patent
Saiga et al.

(10) Patent No.: US 6,868,819 B2
(45) Date of Patent: Mar. 22, 2005

(54) LUBRICATING SYSTEM FOR AN OUTBOARD MOTOR

(75) Inventors: Jiro Saiga, Hamamatsu (JP); Katsuhiro Fukuda, Hamamatsu (JP); Yasushi Miyashita, Hamamatsu (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 286 days.

(21) Appl. No.: 10/242,727

(22) Filed: Sep. 13, 2002

(65) Prior Publication Data

US 2003/0066711 A1 Apr. 10, 2003

(30) Foreign Application Priority Data

Sep. 14, 2001 (JP) ..... 2001/280442

(51) Int. Cl.[7] ..... F01M 1/00
(52) U.S. Cl. ..... 123/196 W; 440/881
(58) Field of Search ..... 123/195 P, 196 W; 440/88 L, 900

(56) References Cited

U.S. PATENT DOCUMENTS 5,524,581 A * 6/1996 Rush et al. ..... 123/196 W
5,778,848 A * 7/1998 Takahashi et al. ..... 123/196 W
5,870,991 A 2/1999 Mineno
5,975,970 A 11/1999 Daikoku
6,450,847 B1 * 9/2002 Kashima et al. ..... 440/88 R

FOREIGN PATENT DOCUMENTS

JP 9-100710 4/1997

OTHER PUBLICATIONS

H. Noriyoshi et al., "Oil Pump Arranging Structure of V–Type Engine for Outboard Engine", Patent Abstract of Japan of JP 10–018827, (1998).

* cited by examiner

*Primary Examiner*—Noah P. Kamen
(74) *Attorney, Agent, or Firm*—Finnegan, Henderson, Farabow, Garrett & Dunner, L.L.P.

(57) ABSTRACT

A lubricating system for an outboard motor equipped with a vertical type engine. In one embodiment, the lubricating system has an oil pump positioned near the bottom of the engine, the oil pump driven by an oil pump rotor that is positioned at a connection between the crankshaft and an engine drive-shaft, the oil pump rotor being linked to the crankshaft. The system further includes a camshaft-driving mechanism for transmitting the rotation of the crankshaft to a propulsion device. The camshaft-driving mechanism is also positioned at the connection between the crankshaft and the drive-shaft and is also linked to the crankshaft. The lubrication system also has a main oil tank for storing lubricating oil circulated by the oil pump, and an engine-cooling water passageway positioned next to the main oil tank. Another element of this embodiment of the lubricating system is a filter-mounting base positioned on an outer wall of the cylinder blocks. The system also has oil passageways positioned at the bottom of the cylinder blocks for distributing the oil.

6 Claims, 10 Drawing Sheets

LUBRICATING SYSTEM FOR AN OUTBOARD MOTOR

DESCRIPTION OF THE INVENTION

1. Field of the Invention

The present invention relates to a lubricating system for an outboard motor.

2. Background of the Invention

A four-cycle engine is equipped with a lubricating system for applying lubricating oil to various moving parts of an engine as the crankshafts and pistons, among other components. For example, one method uses a pressurized oil pump to distribute lubricating oil directly from an oil pan to important parts of an engine. Another method uses gravity to lubricate parts of the engine by placing an oil pan at the highest part of an engine and allowing the lubricating oil to descend naturally. These examples are provided as common methods for distributing lubricating oil to the various parts of an outboard motor.

Because the lubrication of crankshaft bearings is especially important, a method has been used to directly distribute lubricating oil, via pressure, along a path from the main oil distribution passageway be provided on the cylinder block side.

Four-cycle engines are equipped with oil filters for filtering the lubricating oil, and because such oil filters need periodic replacement, it is desirable that they be mounted in a locating that makes them easy to replace. Furthermore, four-cycle engines are also equipped with a pressure switch for confirming that the oil pump is working correctly, and that the oil pressure is maintained at a specified value. In such cases, if the temperature of the lubricating oil is low, its viscosity increases, and the sliding resistance of engine parts also increases. Conversely, if the oil temperature is high, its viscosity diminishes, thus lowering the lubrication property of the oil, causing severe engine deterioration.

In cases where a V-type engine is incorporated into an outboard motor, if the main oil gallery and the oil distribution passageway are provided on the cylinder block side, it is possible that the oil passage from the oil pump to the main oil gallery might be disrupted. Moreover, in the case of an outboard motor, the oil filter is frequently positioned in the lower part of the engine, and outboard motor is enclosed by and engine cover, therefore making it hard to reach the oil filter, often resulting in inadequate and infrequent routine maintenance. Furthermore, a V-type engine incorporated into an outboard motor has a complicated structure, with many parts densely arranged, therefore making it hard to secure a convenient locating for installing a pressure switch. In cases where the oil temperature is not adequately regulated, when the outer air temperature is low, a rise in oil temperature, is due to an extended period of low-speed operation, may not be prevented. Similarly, when the oil temperature is too high, due to an extended period of high-speed operation, this condition is also not addressed.

It is accordingly a primary object of the invention to provide a lubricating system for an outboard motor, which has a simplified structure and secure oil passageways. Another object of this invention consists in providing a lubricating system for an outboard motor which permits easy oil filter changes.

This is achieved by providing a lubricating system having a main oil gallery in the cylinder block of an outboard motor with easily accessible filters on the outer walls of the cylinder block and an engine cooling water component running next to the main oil gallery.

SUMMARY OF THE INVENTION

In accordance with the invention, there is disclosed a lubricating system for an outboard motor. The outboard motor is equipped with a vertical type engine, having cylinder heads, a cylinder block, and a crankcase, and provided with a crankshaft that is almost perpendicular to the joint faces of the crankcase and the cylinder block.

In an embodiment of the lubricating system, the engine has an oil pump, positioned at the bottom of the engine, that is driven by the crankshaft. A driving component of the oil pump and a camshaft-driving mechanism are positioned at the connection between the crankshaft and a drive-shaft. The drive shaft transmits the rotation of the crankshaft to a propulsion system. A main tank of lubricating oil is located in the cylinder block and a descending passageway of engine-cooling water is positioned next to this main oil gallery. In addition, a filter-mounting base is positioned on the outer wall of the cylinder block. Two oil passageways, one extending from the filter-mounting base to the main oil gallery, and another extending from the filter-mounting base to an oil discharge port (of the oil pump), are positioned at the bottom of the cylinder block.

In addition, a filter stand, having the function of changing the direction of flow of the lubricating oil, is mounted on the filter-mounted base, so that the filter-mounting face thereof is almost horizontally directed upward, and an oil filter is placed vertically on this filter-mounting face. Furthermore, a ring-shaped oil collecting groove is positioned in the filter-mounting face of the filter stand, and a wall element, covering a part of the oil filter, is positioned so that it is located below the oil filter when the outboard motor is tilted up to an almost horizontal position.

Furthermore, the engine is a left-right integral, four-cycle, V-type, multi-cylinder engine, arranged with the cylinder block in a V-shape, as viewed from above. Cylinder liners are almost horizontally positioned in the vertical direction (and side-by-side above the cylinder block), with the one-side cylinder liner row positioned in the vertical direction to offset the opposite cylinder liner row. Furthermore, a pressure switch, for confirming that the oil pressure in the main oil gallery is maintained at a specified value is mounted at the upper end of the main oil gallery on this die of the cylinder liner row that is positioned below.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiments of the invention, examples of which are illustrated in the accompanying drawings. Wherever possible, the same reference numbers will be used throughout the drawings to refer to the same or like parts.

Figure 1:
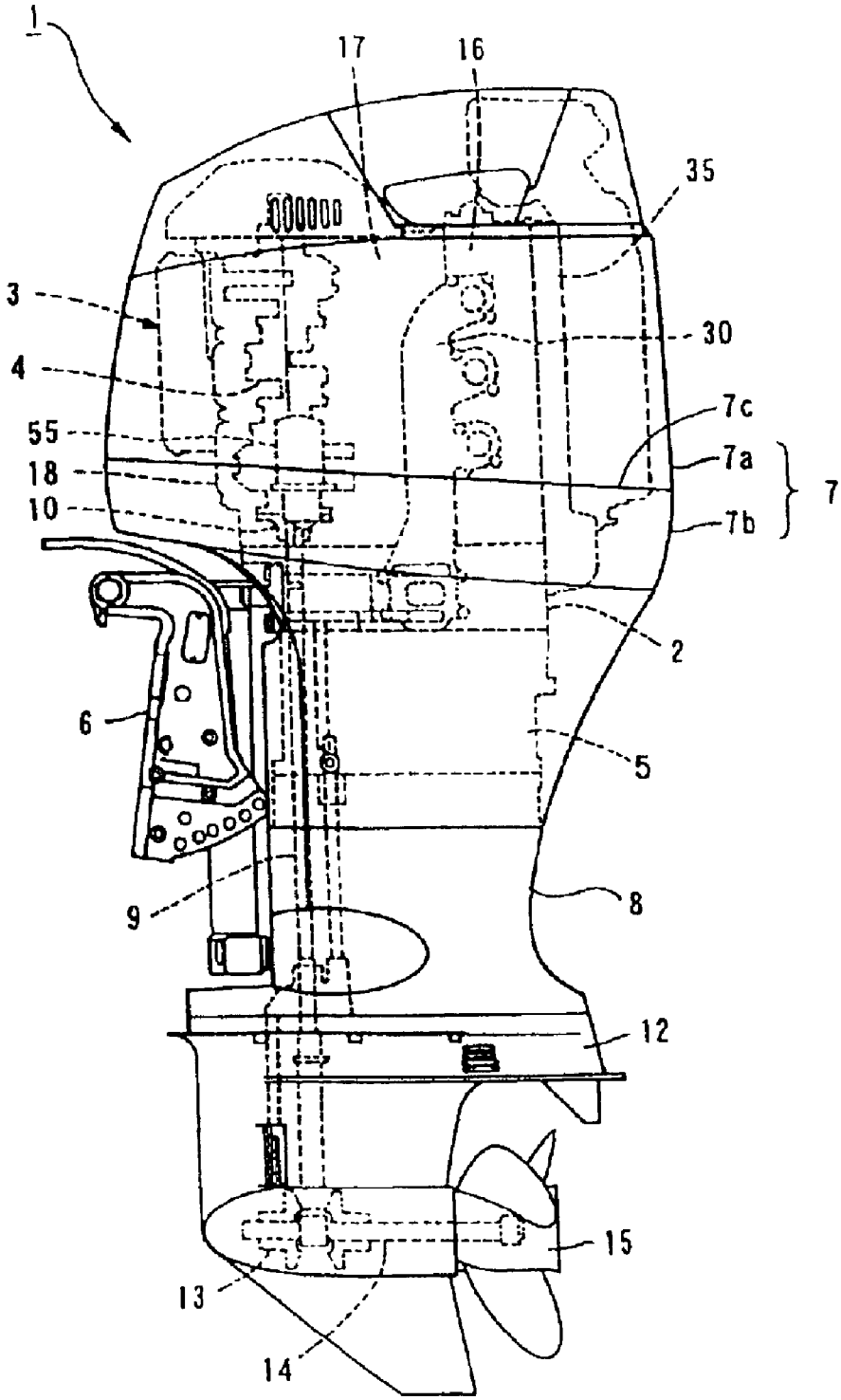
FIG. 1 is a side view of an outboard motor having an embodiment of the lubricating system of the present invention.

In the preferred embodiment of the present invention, the lubricating system can be effectively applied to outboard motor engines, and that embodiment is exemplified by the outboard motor 1 shown if FIG. 1. As shown in FIG. 1, the outboard motor 1 is equipped with an engine holder 2, and an engine 3 is positioned above engine holder 2. Moreover, engine 3 is a vertical (longitudinal) engine, with a crankshaft 4. An oil pan 5 for storing a lubricating oil (not illustrated) is positioned below engine holder 2, and a bracket unit 6 is mounted to outboard motor 1. Outboard motor 1 is installed on a board transom (not illustrated) via bracket unit 6. Outboard motor 1 is so constructed that it is possible to tilt it up to an almost horizontal position, by directing bracket unit 6 toward the front upper part, via a rotating shaft.

The engine 3, engine holder 2, and oil pan 5 are covered by an engine cover 7. Engine cover 7 is fixed to outboard motor 1, and constructed by dividing it into two parts, i.e., a lower cover 7*b*, for covering the lower part of engine 3 and engine holder 2, and a detachable upper cover 7*a*, for covering the upper part of engine 3. In FIG. 1. element 7*c* denotes a division plane of the lower cover 7*b* and the upper cover 7*a*.

A drive-shaft housing 8 is positioned around oil pan 5 and extended downward. A drive-shaft 9, being an output shaft of engine 3, is positioned almost perpendicularly in engine holder 2. A connecting piece 10 connects the upper end of drive-shaft 9 to the lower end of crankshaft 4. Drive shaft 9 and crankshaft 4 are connected via a spline coupling 11, described below. Drive-shaft 9 is constructed so that it extends downward in drive-shaft housing 8 and drives a propeller 15 via a bevel gear 13 and a propeller shaft 14 in a gear case 12 positioned in the lower part of drive-shaft housing 8.

As shown in FIGS. 1–5, engine 3 outboard motor 1 is a water-cooled four-cycle, V-type, six-cylinder engine, which is manufactured by combining cylinder heads 16, a cylinder block 17, and a crankcase 18, among other elements. A V-bank 19 (FIG. 2) is formed within the cylinder block 17 by arranging left-right portions of the cylinder 17 in a V-shape, as viewed from the top. The left-right integral portions of cylinder block 17 are arranged in a V-shape, expanding in the width direction of outboard motor 1 a the rear of crankcase 18, positioned at the front of engine 3 and on the left side of FIG. 1. Cylinder heads 16 are arranged at the rear of cylinder block 17, respectively.

Figure 4:
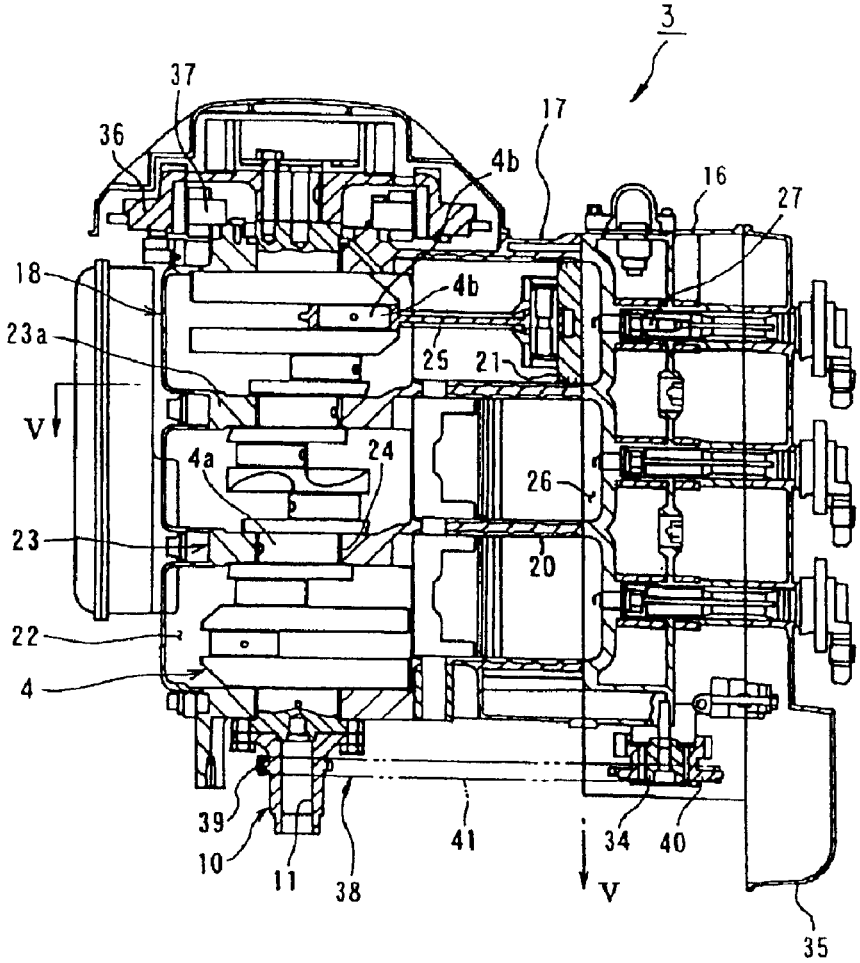
FIG. 4 is a cross-sectional view along a line IV—IV of FIG. 2.
Figure 5:
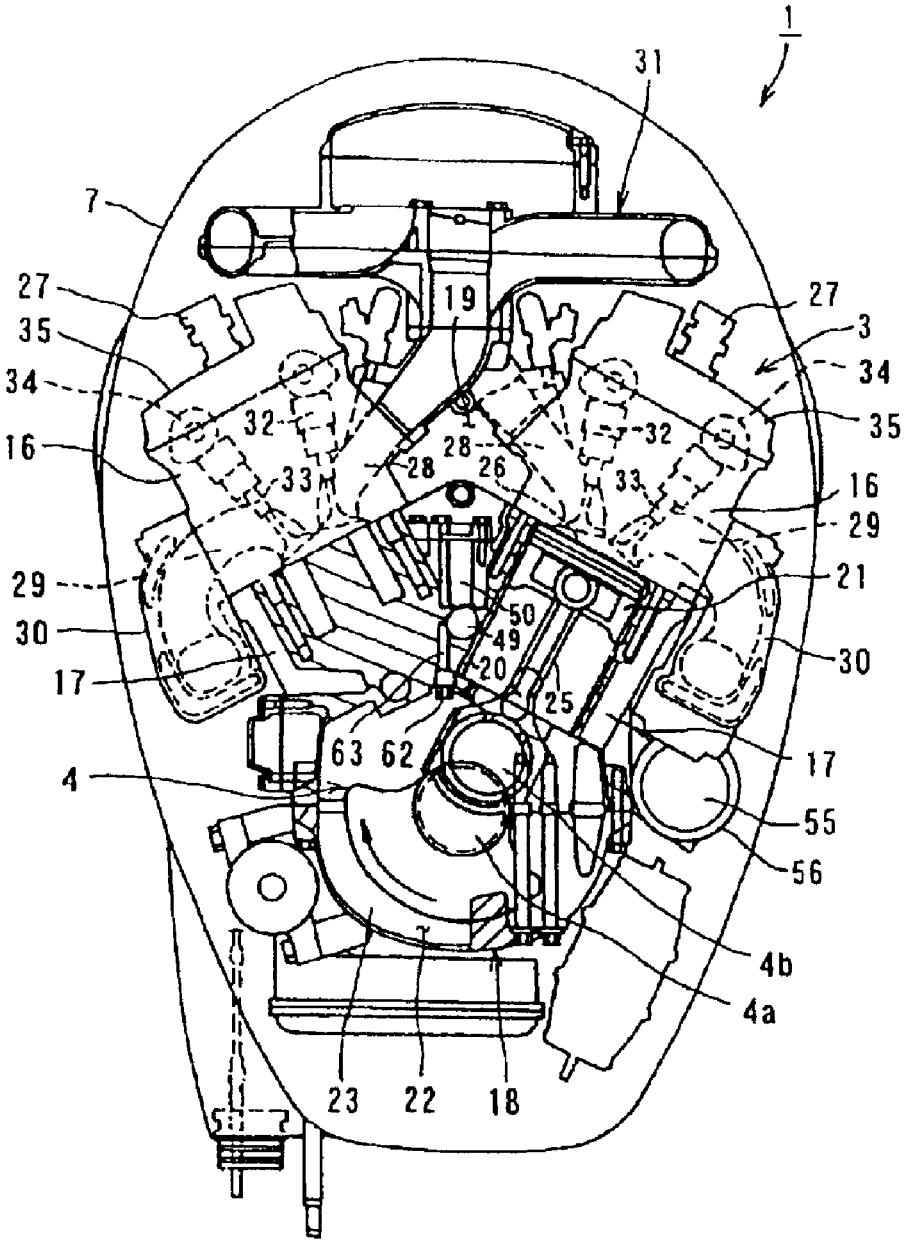
FIG. 5 is a cross-sectional view along a line V—V of FIG. 4.

Three by three cylinder liners 20 (FIG. 6) are horizontally oriented and stacked in the vertical direction, side-by-side in each of the left and right portions of cylinder block 17, respectively. The one-side cylinder liner row is offset to the opposite cylinder liner row. In this embodiment, the right-side cylinder liner row R, is arranged downward, and offset from the left-side cylinder liner row in FIG. 6. As shown in FIGS. 4–5, pistons 21 are slid into cylinder liners 20 in the axial direction on the axis of cylinder liners 20. Crank chambers 22 are formed between crankcase 18 and cylinder block 17, and these crank chambers 22 are divided in the vertical direction for each cylinder by partition walls 23. Moreover, the crank chambers are shared by a left-right pair of cylinder liners 20.

Crankshaft 4 is positioned perpendicularly to the joint face of crankcase 18. Cylinder block 17 and bearings 4*a* of crankshaft 4 are pivoted on bearing axels 23*a* positioned on the joint face of crankcase 18 and cylinder block 17. Moreover, crankshaft 4 and pistons 21 are connected by connecting rods 25 to convert reciprocal strokes of pistons 21 to the rotating motion of crankshaft 4.

Combustion chambers 26, matching with the cylinder liners 20, are positioned on the cylinder heads 16, respectively, and ignition plugs 27 are installed from the outside into each combustion chamber. Intake ports 28 and exhaust ports 29, linking with the combustion chambers 26, are also positioned in the cylinder heads 16. As shown in FIG. 5, the exhaust ports 29 are connected with an exhaust unit 30 positioned on the outer side of the left-rights cylinder heads 16. Intake ports 28 are extended into V-bank 19, formed on the inner side of cylinder heads 16 and the left and right portions of cylinder block 17, and connected with an intake unit 31 positioned from the V-bank 19 to the rear of engine 3.

Figure 3:
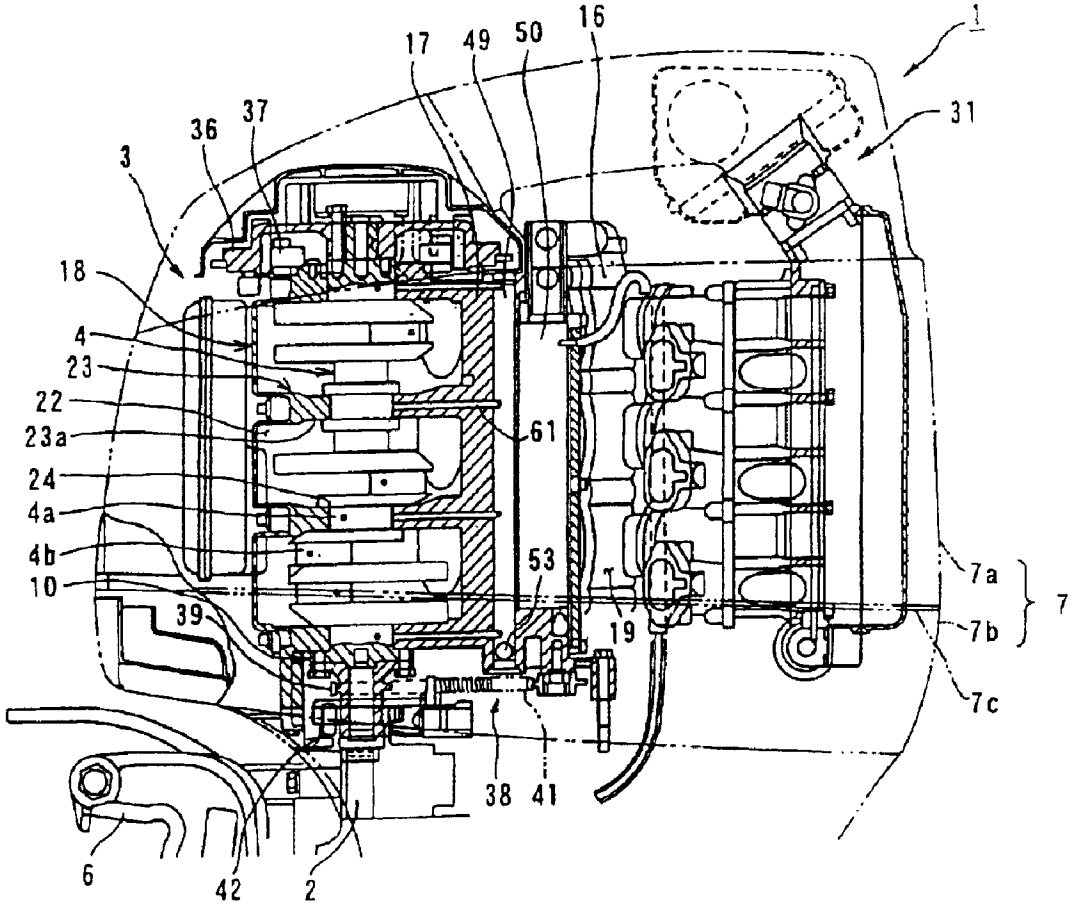
FIG. 3 is a cross-sectional view along a line III—III of FIG. 2.

Moreover, intake valves 32 and exhaust valves 33, for opening and closing intake ports 28 and exhaust ports 29, are positioned in cylinder heads 16. Two camshafts 34 that open and close intake valves 32 and exhaust valves 33 are arranged parallel to crankshaft 4 at the rear of cylinder heads 16, respectively. Then, cylinder heads 16 are covered by cylinder head covers 35. Furthermore, as shown in FIGS. 3 and 4, the upper end of the crankshaft 4 protrudes above the engine 3. A flywheel 36 and a magnet unit 37, for power generation, are provided at this protrusion.

Figure 7:
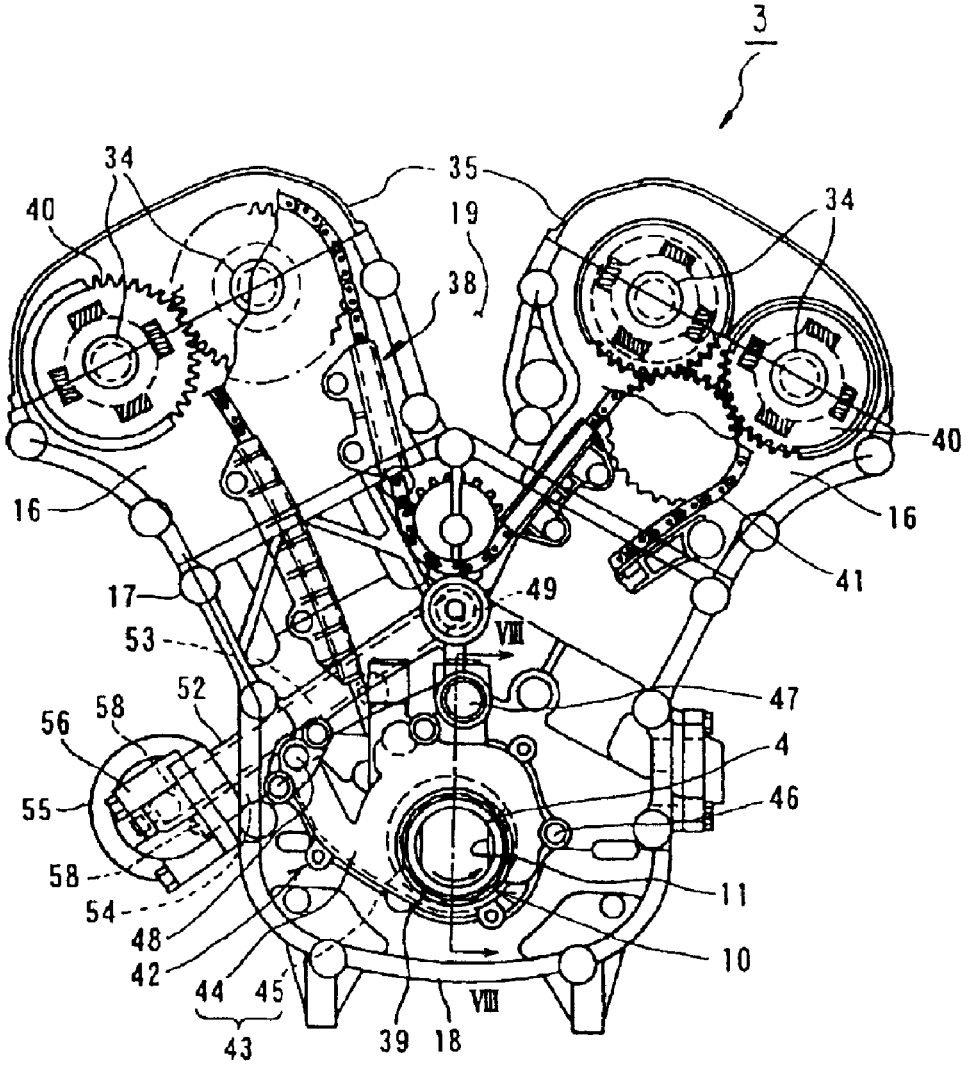
FIG. 7 is the bottom view of an outboard motor having the embodiment of the lubricating system of the present invention.
Figure 8:
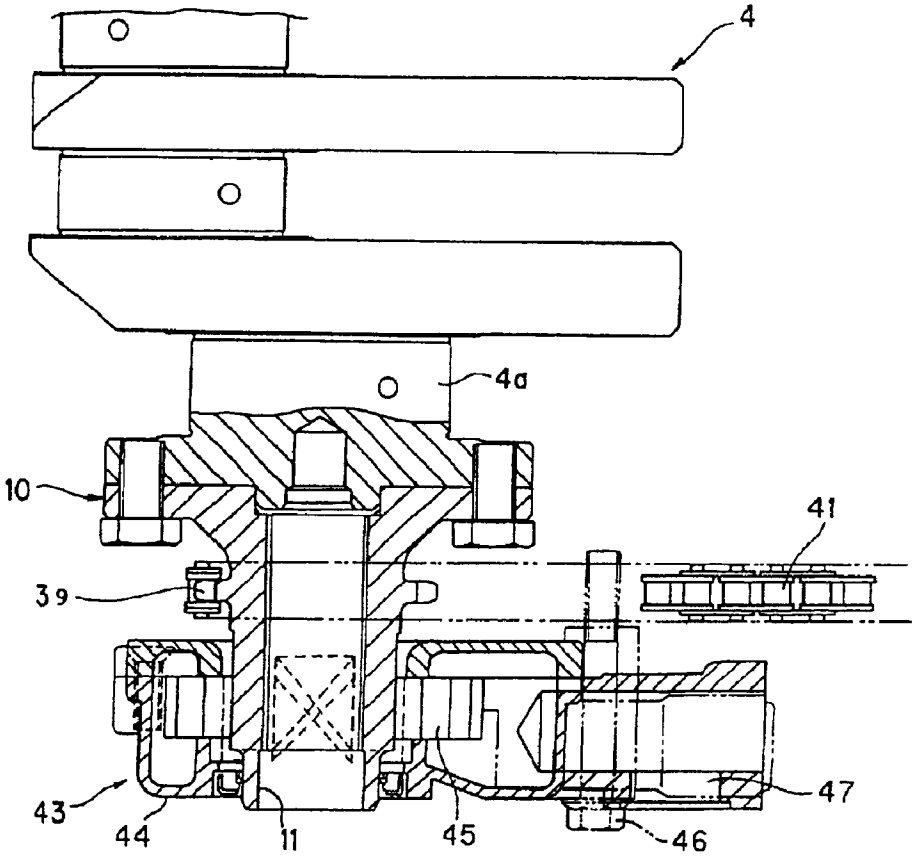
FIG. 8 is a cross-sectional view along a line VIII—VIII line of FIG. 7.

Furthermore, a camshaft drive mechanism 38, for transmitting the rotation of crankshaft 4 to camshaft 34, is provided below engine 3. This camshaft drive mechanism 38 is, in this example, a chain-drive model, and, as shown in FIGS. 4, 7, and 8, a timing sprocket 39 is positioned on a connecting piece 10 with the drive-shaft 9 and fastened to the lower end of the crankshaft 4. Cam sprockets 40, provided at the lower end of the camshafts 34 and a timing chain 41, wind around sprockets 39 and 40.

Engine 3 is equipped with a lubricating device 42. The lubricating device 42 distributes lubricating oil stored in oil pan 5 to parts of engine 3 by a pressurized oil pump 43 driven by crankshaft 4. The lubricating oil is recovered in oil pan 5. Oil pump 43 is mainly composed of a casing 44 and a rotor 45 being a driving component of oil pump 43. Rotor 45 is arranged on the same axis as the crankshaft 4, and the casing 44 is retained with bolts 45 at the bottom surface of cylinder block 17 and crankcase 18. Moreover, rotor 45 is housed in casing 44, pressed into connecting element 10 of crankshaft 4 and drive-shaft 9 to integrally rotate with crankshaft 4. Furthermore, an oil intake port 47 and an oil discharge port 48 for the lubricating oil are positioned in casing 44, and oil intake pipe (not illustrated) is connected to oil intake port 47. The intake pipe's upstream end is extended to the oil pan 5.

Furthermore, a main oil gallery 49 for the lubricating oil in the valley of V-bank 19 is positioned toward the vertical direction in cylinder block 17. Moreover, a descending passageway 50 (FIG. 5) of engine cooling water is positioned next to main oil gallery 49, e.g., at the rear of main oil gallery 49. A filter-mounting 52 (FIG. 6), having a mounting face 51, is positioned on the outer wall of cylinder block 17, and a first oil passage 53, joined by extending it from the mounting base 52 to the main oil gallery 49, is formed at the bottom surface of cylinder block 17. A second oil passage 54, extending from the mounting base 52 and nearly parallel to the first oil passage 53, is positioned at the bottom of cylinder block 17, and is connected to oil discharge port 48 of oil pump 43.

Figure 9:
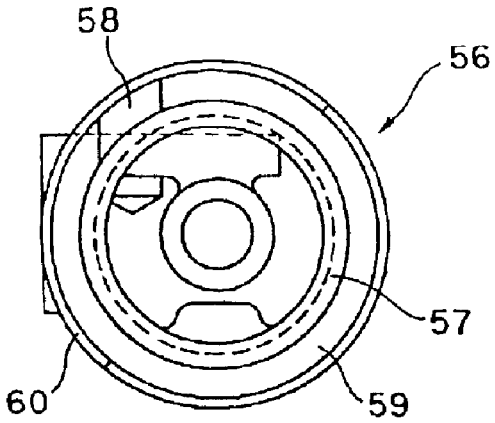
FIG. 9 is a plan view of a filter stand used in the embodiment of the lubricating system of the present invention.
Figure 10:
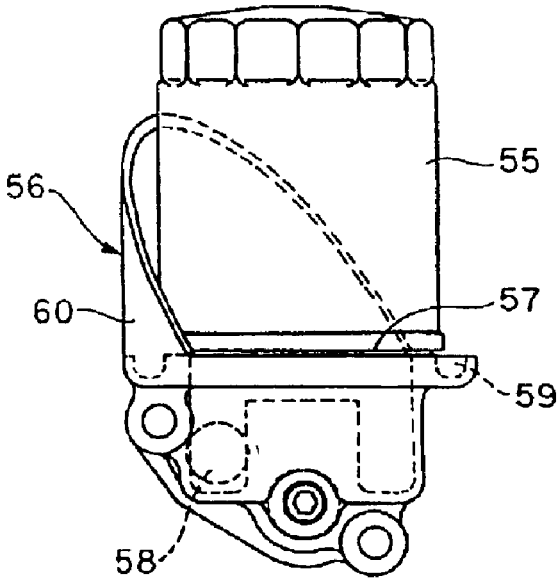
FIG. 10 is a side view of the filter stand of FIG. 9.

An oil filter 55, for filtering the lubricating oil before it is supplied to the parts of engine 3, is detachably mounted to the filter-mounting base 52 via a filter stand 56. As shown in FIGS. 9 and 10, filter stand 56 has a generally horizontal upwardly directed filter-mounting face 57. An oil filter 55 is inserted vertically at this filter-mounting face 57, and two (distribution and collection) connecting passages 58, for changing the flow direction of the lubricating oil 90°, are formed inside the filter stand 56. Moreover, a ring-shaped oil collection groove 59 is formed in the filter-mounting face 57 of filter stand 56, and wall element 60 is placed vertically, so as to cover a part of oil filter 55. Furthermore, this wall element 60 is positioned so that it is located below oil filter 55, when outboard motor 1 is tilted up to an almost horizontal position.

Figure 6:
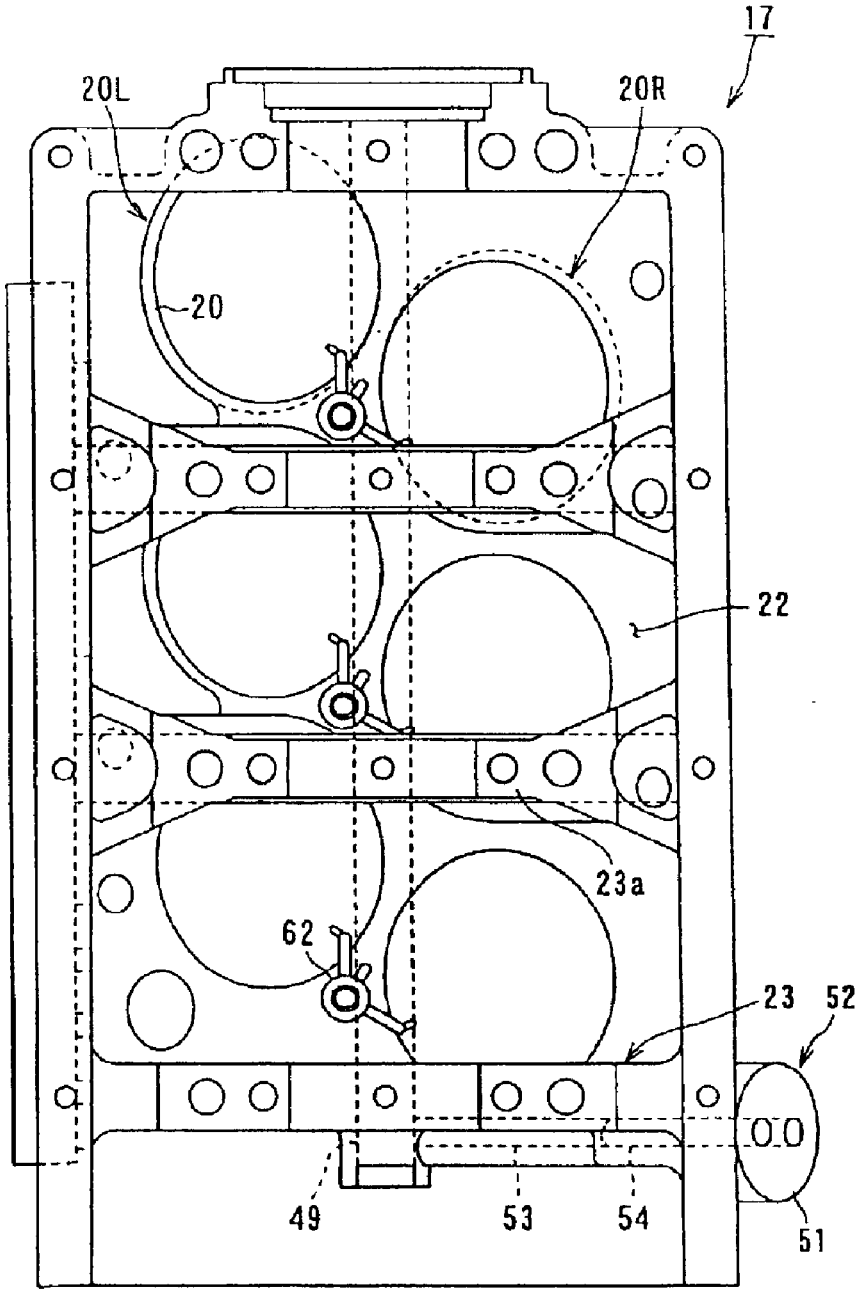
FIG. 6 is a cross-sectional view as seen from the joint face of the cylinder block and the crankcase in an outboard motor having the embodiment of the lubricating system of the present invention.

As shown in FIGS. 3 and 6, oil distribution passageways 61 extend from the main oil gallery 49 to the sliding surfaces of the bearing axles 23*a*. As shown in FIGS. 5 and 6, oil jets 62, pointing into cylinder liners 20, are provided at the walls facing the crank chambers 22 between the left-right cylinder liners 20. Oil distribution passageways 63 extend from the main oil gallery 49 to the upstream side of oil jets 62. Moreover, the lubrications inside crankshaft 4 and pistons 21 is carried out by distributing the lubricating oil, via pressure generated by oil pump 43, to bearing axles 23*a* and oil jets 62. The lubricating oil goes through oil filter 55 and main oil gallery 49, and covers the sliding surfaces of bearings 4*a* of crankshaft 4, and bearings 24 and the sliding surfaces of cylinder liners 20 and pistons 21.

Figure 2:
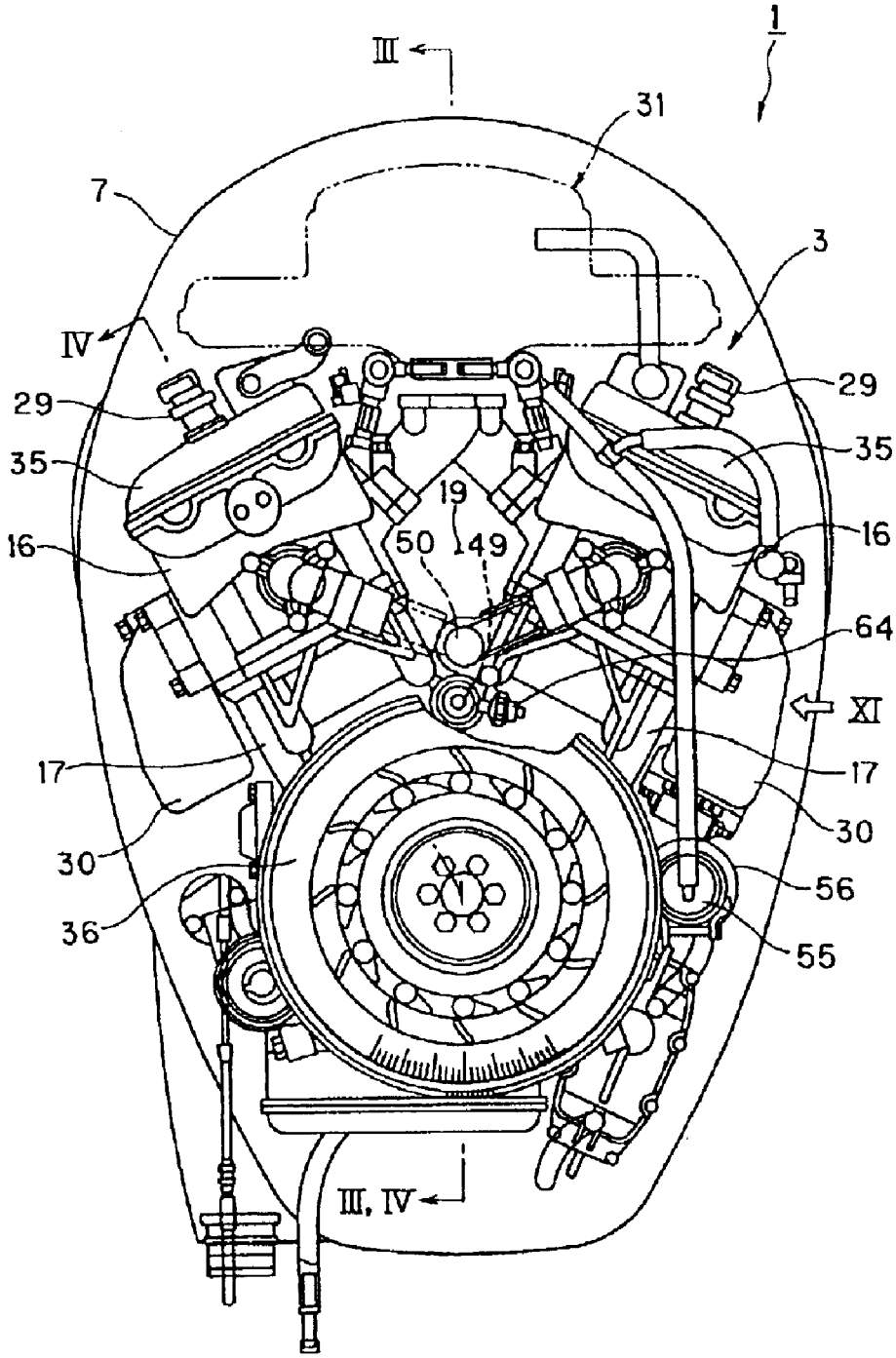
FIG. 2 is a plan view of the outboard motor of FIG. 1.
Figure 11:
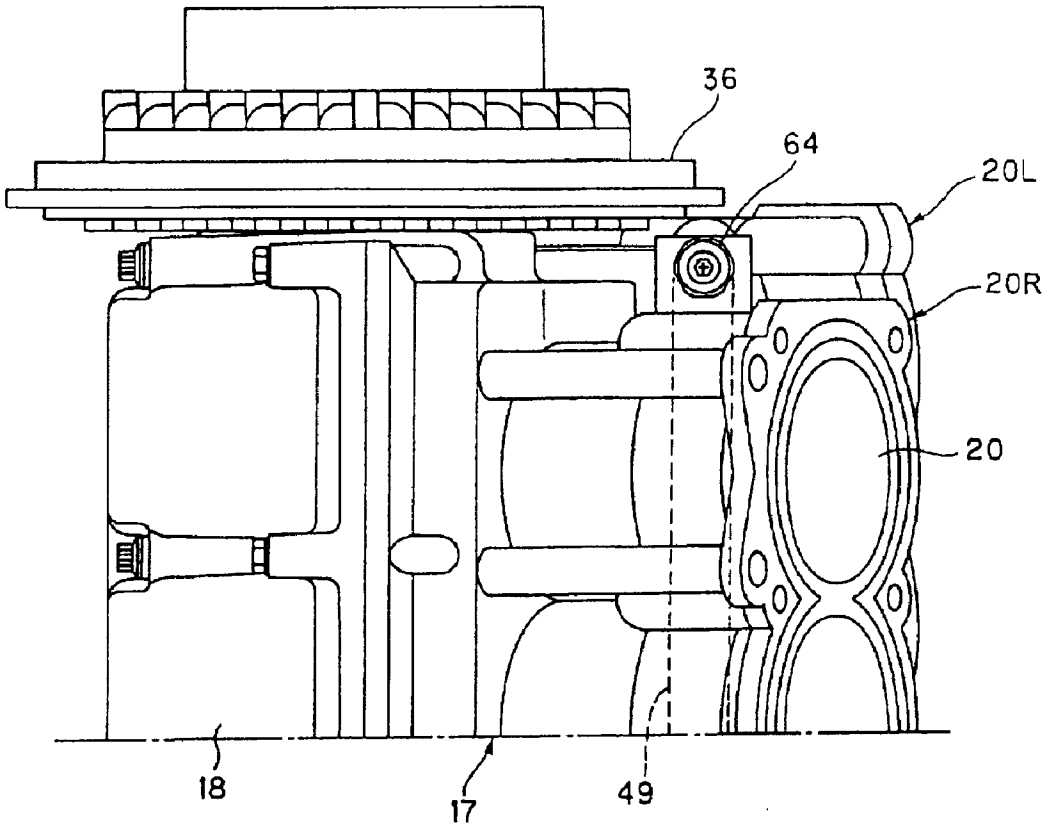
FIG. 11 is a cross-sectional view along a line XI—XI of FIG. 2.

As shown in FIGS. 2 and 11, a pressure switch 64, for confirming that oil pump 43 is operating normally and that the oil pressure in main oil gallery 49 maintains a specified value, is positioned a the upper end of main oil gallery 49, on the side of the offset cylinder liner row positioned below, and this embodiment, on the side of right cylinder liner row R, in FIG. 2.

By positioning oil pump 43, driven by crankshaft 4, at the bottom surface of cylinder block 17 and crankcase 18, and positioning filter-mounting base 52 on the outer wall of cylinder block 17, it is possible to vertically position main oil gallery 49 in cylinder block 17, between the V-bank 19. It also becomes possible to position first oil passageway 53, which extends and connects from mounting base 52 to main oil gallery 49, and second oil passageway 54, which extends and connects from mounting base 52 to oil discharge port 48 of oil pump 43, at the bottom of cylinder block 17. As a result, this embodiment of the invention allows for the positioning of oil distribution passageways 51 from main oil gallery 49 to the sliding faces of bearing axles 23*a* and bearings 4*a* of crankshaft 4 on cylinder block 17. This shortens first and second oil passageways 53 and 54 respectively, and oil distribution passageways 61 and 63, and simplifies of the overall layout.

Moreover, this embodiment enables the positioning of oil filter 55 above the division plane 7*c* of lower cover 7*a* and upper cover 7*b*. This is achieved by mounting filter stand 56, with the ability to change the flow direction of the lubricant oil by 90°, to filter-mounting base 52 which has an almost perpendicular mounting face 51, so as to face it almost horizontally, and vertically positioning the oil filter 55 on filter-mounting face 57 (FIG. 1). As a result, oil filter 55 is positioned above the first and second oil passageways 53 and 54, respectively even if the passageways extending longitudinally are not positioned on the engine 3 side, therefore the shortening of oil passageways 53 and 54 and the simplification of the overall layout can be accomplished and the effectiveness and ease of replacing the oil filter 55 is markedly improved.

Furthermore, when the ring-shaped oil collection groove 59 is positioned on filter-mounting face 57 of filter stand 56, and outboard motor 1 is tilted up to an almost horizontal position, the replacement of oil filter 55 can be made without spilling the lubricating oil, regardless of how the outboard motor is positioned, by arranging wall element 60, covering a part of oil filter 55, so that it is located below oil filter 55. Additionally, in this embodiment, oil pump 43 is so constructed that it is driven by crankshaft 4 (and positioned on the same axis as the crankshaft 4), therefore oil filter 55 can be positioned in a recessed area of the lateral surface of engine 3, and positioned near the joint face of crankcase 18 and cylinder block 17, thereby shortening and simplifying the oil passageways 53, 54.

Furthermore, spline coupling 11 of drive-shaft 9, and timing sprocket 39 (forming the camshaft driving mechanism 38), are mounted integrally, as rotor 45 (forming oil pump 43) is mounted integrally with the connecting piece of crankshaft 4 and drive-shaft 9. This embodiment, therefore, successfully reduces the number of parts, improves the effective utilization of space (through miniaturization), and reduces the overall weight of the entire outboard motor 1.

Furthermore, by positioning engine-cooling water descending passageway 50 next to main oil gallery 49, the engine-cooling water always keeps the lubricating oil at the proper temperature thereby securing a high level of performance of engine 3. Given these changes, the engine effectively uses dead space and the distribution of cooling water pipes (not illustrated) is facilitated. In addition, by mounting pressure switch 64 on the cylinder liner row 20 R side and at the upper end of main oil gallery 49 and by positioning it offset and downward, the pressure switch 64 no longer interferes with surrounding components, such as the flywheel 36.

Other embodiments of the invention will be apparent to those skilled in the art from consideration of the specification and practice of the invention disclosed therein. It is intended that the specification and examples be considered as exemplary only, with a true scope and spirit of the invention being indicated by the following claims.

What is claimed is:

1. A lubricating system for an outboard motor equipped with a vertical type engine, the vertical type engine having a cylinder block, cylinder heads, a crankcase, and a crankshaft, the lubricating system comprising:

an oil pump positioned near the bottom of the engine, the oil pump driven by an oil pump rotor that is positioned at a connection between the crankshaft and an engine drive-shaft, the oil pump rotor being linked to the crankshaft, a main oil gallery for storing lubricating oil circulated by the oil pump, the main oil gallery located in the cylinder block;

an engine-cooling water passageway positioned next to the main oil gallery;

a filter-mounting base positioned on an outer wall of the cylinder block;

a first oil passageway positioned at the bottom of the cylinder block and extending from the filter-mounting base to the main oil gallery;

a second oil passageway positioned at the bottom of the cylinder block and extending from the filter-mounting base to an oil discharge port of the oil pump; and a filter stand mounted on the filter-mounting base, the filter stand having a generally horizontal, upwardly directed filter-mounting face for receiving an oil filter and two connecting passageways formed inside the filter stand for changing the flow direction of lubricating oil.

2. The lubricating system for an outboard motor of claim 1 further comprising:

a ring-shaped oil collecting groove formed in the filter-mounting face of the filter stand; and a wall element covering a part of the oil filter and located below the oil filter when the outboard motor is tilted up to a generally horizontal position.

3. The lubricating system for an outboard motor of claim 1 wherein the engine is a left-right integral, four-cycle, V-type, multi-cylinder engine, arranged with the cylinder block in a V-shape, as viewed from above.

4. The lubricating system for an outboard motor of claim 2 wherein the engine is a left-right integral, four-cycle, V-type, multi-cylinder engine, arranged with the cylinder block in a V-shape, as viewed from above.

5. The lubricating system for an outboard motor of claim 3 further comprising:

at least two cylinder liners horizontally oriented and stacked in the vertical direction and also positioned side-by-side above the cylinder block;

a one-side cylinder liner row positioned in the vertical direction to offset an opposite cylinder liner row; and a pressure switch for confirming that an oil pressure in the main oil gallery is maintained at a specified value, the pressure switch mounted at an upper end of the main oil gallery and on the side of the one-side cylinder liner row.

6. The lubricating system for an outboard motor of claim 4 further comprising:

at least two cylinder liners horizontally oriented and stacked in the vertical direction and also positioned side-by-side above the cylinder block;

a one-side cylinder liner row positioned in the vertical direction to offset an opposite cylinder liner row; and a pressure switch for confirming that an oil pressure in the main oil gallery is maintained at a specified value, the pressure switch mounted at an upper end of the main oil gallery and on the side of the one-side cylinder liner row.

* * * * *